United States Patent [19]

Küsters

[11] Patent Number: 4,768,734

[45] Date of Patent: Sep. 6, 1988

[54] WARP WINDING APPARATUS

[75] Inventor: Karl H. Küsters, Tönisvorst, Fed. Rep. of Germany

[73] Assignee: Harcoba Textilmaschinen GmbH & Co. KG, Wuppertal, Fed. Rep. of Germany

[21] Appl. No.: 82,834

[22] Filed: Aug. 6, 1987

[30] Foreign Application Priority Data

Aug. 18, 1986 [DE] Fed. Rep. of Germany ..... 3627946

[51] Int. Cl.[4] ..... B65H 49/14

[52] U.S. Cl. ..... 242/131.1; 28/193

[58] Field of Search ..... 242/131.1, 131, 35.5 R; 28/193, 190, 208

[56] References Cited

U.S. PATENT DOCUMENTS 1,885,114 11/1932 Klein ..... 242/131.1

2,542,097 2/1951 Shaffer et al. ..... 242/131.1

FOREIGN PATENT DOCUMENTS 710503 6/1954 United Kingdom ..... 242/131.1

*Primary Examiner*—Stanley N. Gilreath

*Attorney, Agent, or Firm*—Herbert Dubno

[57] ABSTRACT

A creel is used with a winder having a predetermined width and operable to draw in across this width in a normally horizontal longitudinal transport direction a warp of filaments from respective bobbins. The creel comprises a support frame having respective supports for the bobbins and having a pair of generally like sides each provided with a respective half of the supports. The sides are elongated in the transport direction and have downstream ends spaced by at least the winder width, upstream ends more closely spaced, and inner faces turned transversely inward toward each other. Respective deflectors on the inner faces of the support sides guide the filaments inward and transversely of the transport direction from the respective supports and then longitudinally in the transport direction to the winder. The filaments normally run from the deflectors to the winder without touching any substantial guide structure. A spreader is provided at the downstream ends for raising and splitting the warp of filaments for operator access through the split warp to between the sides of the support frame.

12 Claims, 3 Drawing Sheets

IV
V
V
L
11
21
29
32
34
13'
13''
13'''
A
B
C
D

UPSTREAM SPOOLS
DOWNSTREAM SPOOLS
21
33
34
35
36
37
30
31
31'
31''
13'
13''
16
A
B
C
D
A'
B'
C'
D'
b
h 11
14
13'
13''
13'''
13IV
24
22'
32
36
30
b'

WARP WINDING APPARATUS

FIELD OF THE INVENTION

The present invention relates to an apparatus for winding a warp. More particularly this invention concerns an apparatus for winding a plurality of warp yarns or filaments up onto a warp beam or the like.

BACKGROUND OF THE INVENTION

For many weaving and knitting operations it is necessary to wind a warp of filaments or yarns up next to one another on a warp beam or the like. The device used for this purpose includes a so-called creel or supply having a multiplicity of supports each carrying a respective bobbin. The yarns from the bobbins pass through an appropriate guide or comb to the winder where they are wound up one next to the other on the warp beam.

A standard such device, known as a V-creel, has a pair of substantially identical sides symmetrically flanking a vertical plane extending in the longitudinal transport direction that the yarns move in toward the winder. The two sides extend at an angle of about 30° to each other with the point of the V directed downstream toward the winder, that is with the apex angle of the creel open upstream away from this winder. Thus the space between the sides of the creel is empty because the yarns are drawn directly away from the outside of the creel. Each yarn or thread passes through a respective thread brake but otherwise does not engage any other structure, as the drag created by the air through which the filaments pass is substantial when the device is operating at the high speeds typically employed in a modern winding system.

The main disadvantage of such a device is that it is fairly bulky. In fact for a system about 20 m long it is standard to construct the creel about 15 m wide. Such width is essential to prevent adjacent yarns from catching on one another and becoming tangled. This size is a substantial disadvantage.

OBJECTS OF THE INVENTION

It is therefore an object of the present invention to provide an improved yarn-winding apparatus.

Another object is the provision of such a yarn-winding apparatus which overcomes the above-given disadvantages, that is which is relatively compact.

A further object is to provide a creel and winder which are compact and easy to service.

SUMMARY OF THE INVENTION

A creel according to this invention is used with a winder having a predetermined width and operable to draw in across this width in a normally horizontal longitudinal transport direction a warp of filaments from respective bobbins. The creel comprises a support frame having respective supports for the bobbins and having a pair of generally like sides each provided with about one respective half of the supports. The sides are elongated in the transport direction and have downstream ends spaced by at least the winder width, upstream ends more closely spaced, and inner face turned transversely inward toward each other. Respective deflectors on the inner faces of the support sides guide the filaments inward and transversely of the transport direction from the respective supports and then longitudinally in the transport direction to the winder. The filaments normally run from the deflectors to the winder without touching any substantial guide structure. A yarn lifter is provided at the downstream ends for raising and splitting the warp of filaments for operator access through the split warp to between the sides of the support frame.

It is important according to the invention that the downstream ends of the sides be spaced at least by the effective width of the winder, which is normally the width of the warp or the like being wound. Thus the warp of yarns has sufficient space that it can be drawn in and fed without guides from the middle of the creel. This guiding of the yarns inward, by which is meant that the yarns of one side of the creel machine are pulled toward the other side and vice versa, means that instead of extending at an angle of 35° like the prior-art devices, the sides of the creel according to this invention can form a much smaller angle and, therefore, take up a great deal less floor space.

According to the invention the upstream ends are spaced apart by a gap sufficiently wide for a machine operator to pass through and in addition the deflectors are spaced such that the filaments from one of the sides are laterally spaced at the downstream ends from the filaments of the other side by another gap sufficiently wide for a machine operator to pass through. This makes operator access from both ends of the creel possible, something that is essential to service and load the machine. Thus the machine operator need not always run to one or the other end of the creel in order to gain access to the bobbins and guides. Instead access can be had under the split and raised warp of yarns. In addition the fact that the closer upstream ends are separated by a distance wide enough for the operator to pass through makes it possible to gain access to the bobbins furthest upstream, and similar extra spacing at the upstream end ensures that when the warp of yarns is split the separation will be wide enough even at the downstream end for operator access. When there is no yarn lifter which acts as a yarn spreader, but merely a device for raising the filaments, such extra spacing at the downstream end is essential.

Thus according to this invention the sides form a V open in the transport direction toward the winder and forming an angle of less than 20°. In addition the raising and splitting means includes an at least partially horizontal bar vertically displaceable on the frame. The bar has a pair of transversely spaced horizontal portions having inner ends and a pair of upwardly inclined portions extending inward from the inner ends. The upwardly inclined portions symmetrically flank a centerline of the creel extending in the transport direction. In addition the horizontal portions have outer ends vertically displaceably supported on the respective support sides. The raising and splitting means includes a drive motor mounted on the support, and a mechanical linkage, for instance a rack and pinion or spindle and worm, connecting the motor to the outer ends. In addition, according to this invention, the winder maintains the filaments taut as the bar is lowered. This is achieved by rotating the winder at a very slow creep as the bar is being lowered to prevent the slack thus created from allowing adjacent filaments to touch and become tangled.

DESCRIPTION OF THE DRAWING

The above and other objects, features, and advantages will become more apparent from the following, reference being made to the accompanying drawing in which.

SPECIFIC DESCRIPTION

Figure 1:
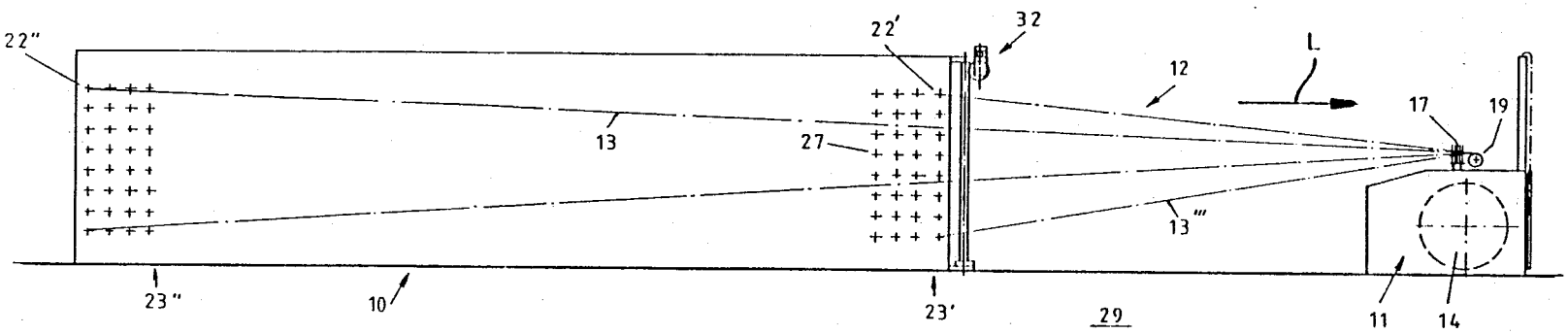
FIG. 1 is a small-scale and partly diagrammatic side view of the apparatus of this invention.
Figure 2:
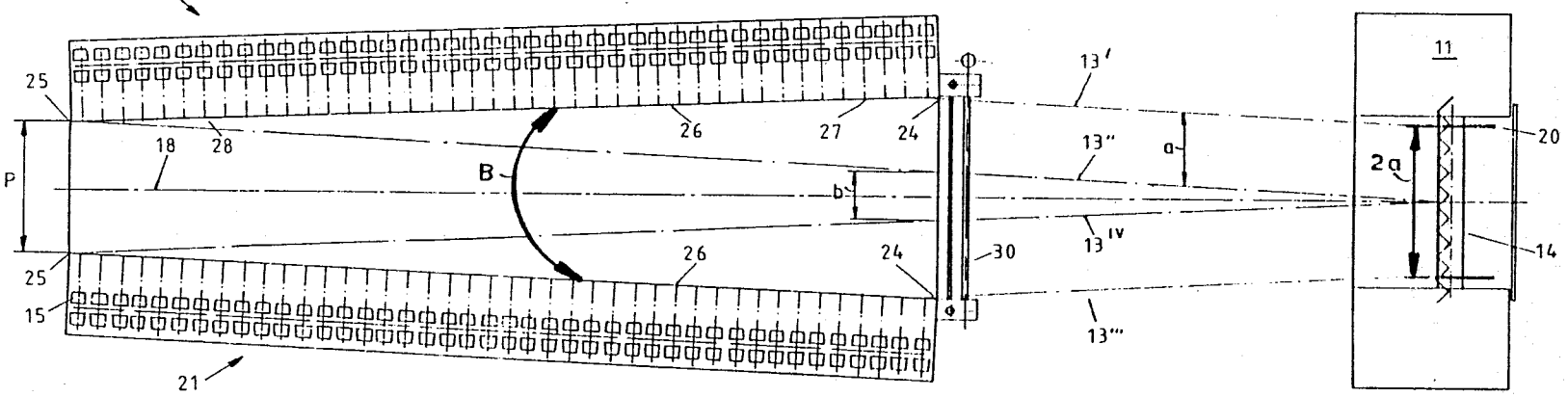
FIG. 2 is a top view of the apparatus of FIG. 1.
Figure 3:
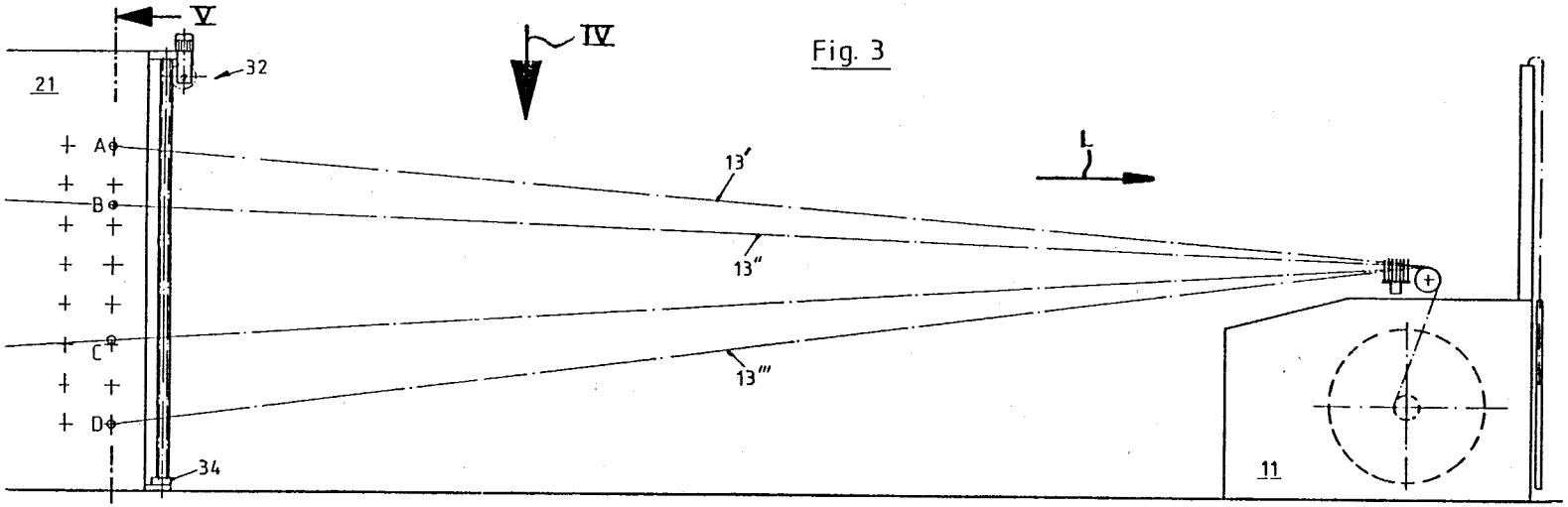
FIG. 3 is a larger-scale side view of the winding part of the apparatus of the instant invention.

As seen in FIGS. 1 through 8 the apparatus of this invention basically feeds a warp 12 of yarns 13 in a yarn-travel direction L from an upstream creel 10 to a downstream winder 11. The filaments 13 are drawn from respective bobbins or spools 15 at first transversely of the direction L to pass around deflectors shown schematically in FIG. 5 at 16, then longitudinally through a comb 17 carried on the winder 11, then over a deflecting roller 19 supported between the sides 20 of the winder 11, to finally wind up on a warp beam 14 extending horizontally perpendicular to the direction L like the roller 19 and comb 17. This piece of equipment can for example be used to make up a warp beam for wide-loom weaving.

The creel 10 itself is symmetrical about a vertical plane including a longitudinal central axis 18 of the piece of equipment 10, 11. Thus this creel 10 has two identical sides 21 symmetrically flanking the axis 18 and forming an apex angle B of only 5° with each other, this angle B being open in the upstream direction, that is opposite to the direction L and away from the winder 11. In this manner the uppermost yarns 13′ and 13″ of the uppermost spool locations 22′ and 22″ of the extreme downstream and upstream upright spool rows 23′ and 23″ of the left side (looking in the direction L) extend parallel to one another at a spacing a equal to half of the effective width 2*a* of the warp being produced on the beam 14. The corresponding yarns 13‴ and $13^{iv}$ of the opposite side 21 of the creel 10 are similarly parallel and spaced by the distance a. The small angle B means that these yarns 13 will only very lightly engage the comb 17.

Ideally of course the downstream ends 24 of the inner faces 26 of the two sides 21 would be spaced by the distance 2*a* and the upstream ends 25 would touch, ensuring perfectly parallel movement of all of the yarns 13 from the respective guides 16 without deflection by the comb 17. Such construction would, however, completely block the machine operator from entry between the sides 21 for access to the guides 16 at the surfaces 26, making repair of the inevitable yarn break or reloading of the machine virtually impossible. Limited access to the length of the operator's arm would only be possible from the downstream end of the creel 10 to, for instance, a downstream spool location 27 but would make it impossible, for instance, to gain access to a spool at an upstream location 28.

According to the invention, therefore, the upper ends 25 are spaced apart at a lateral spacing p sufficient to allow a person to enter from this end. The exact size of this accessway can be easily determined by reference to, for instance, *Architect's Graphic Standards* of Ramsey and Beeler (publisher: John Wiley) and is preferably set so the operator can enter walking normally. At the downstream ends 24 the yarns 13 therefore form two groups or subwarps bounded as shown in the hatched regions of FIG. 5 by two isosceles trapezoids A-B-C-D and A′-B′-C′-D′ separated by a gap of horizontal width b which is just barely wide enough for an operator to pass through, normally sideways, the total dimension (b+2a) being equal to the transverse spacing of these downstream ends 24. In a preferred arrangement b is as large as and in fact is equal to p.

Figure 5:
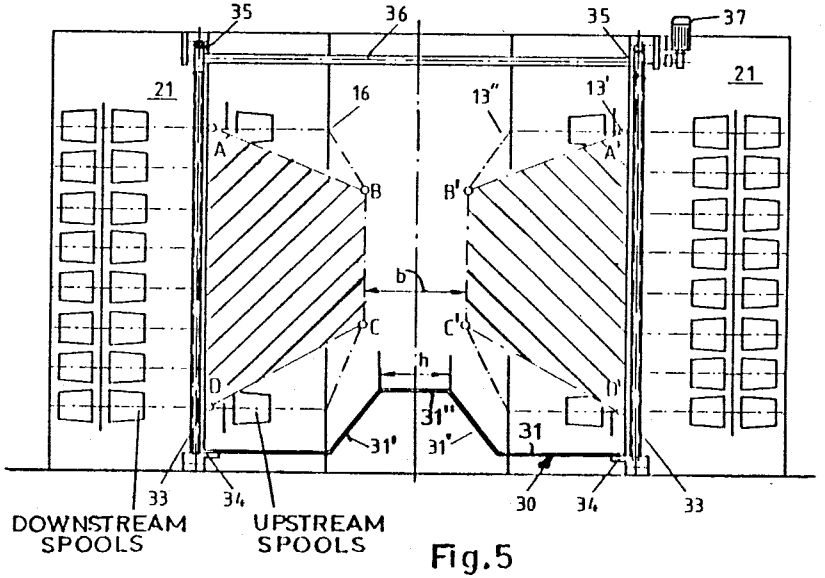
FIG. 5 is a vertical section taken along line V—V of FIG. 3.
Figure 4:
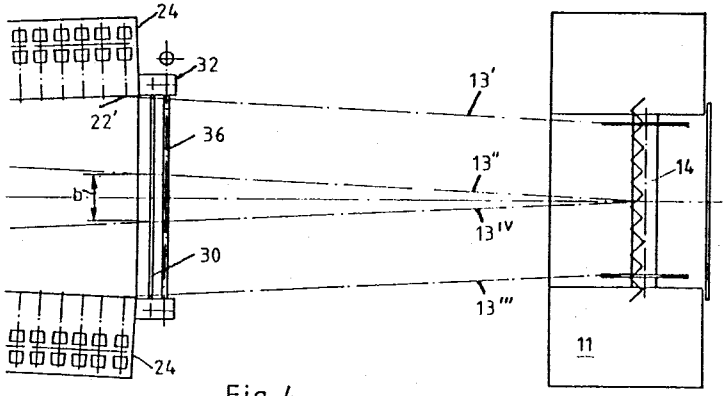
FIG. 4 is a smaller-scale top view taken in the direction of arrow IV of FIG. 3.
Figure 6:
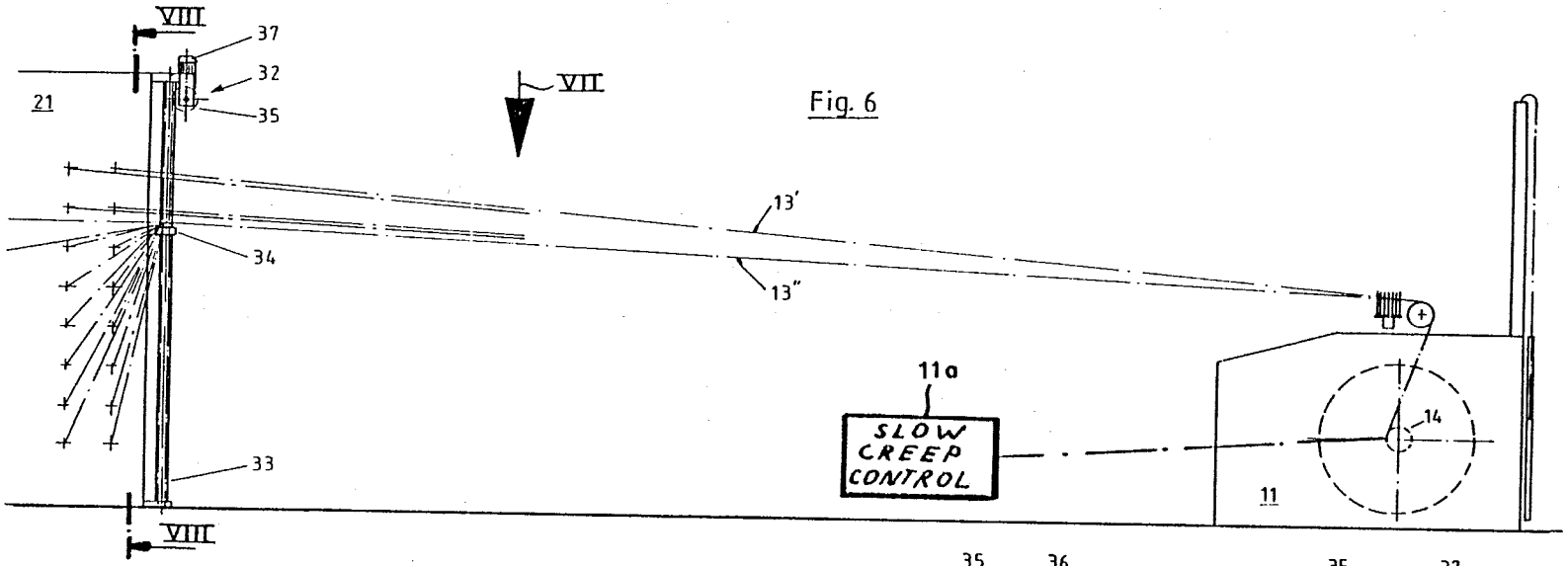
FIG. 6 is a view like FIG. 1 but showing the apparatus with the yarns lifted for servicing.
Figure 8:
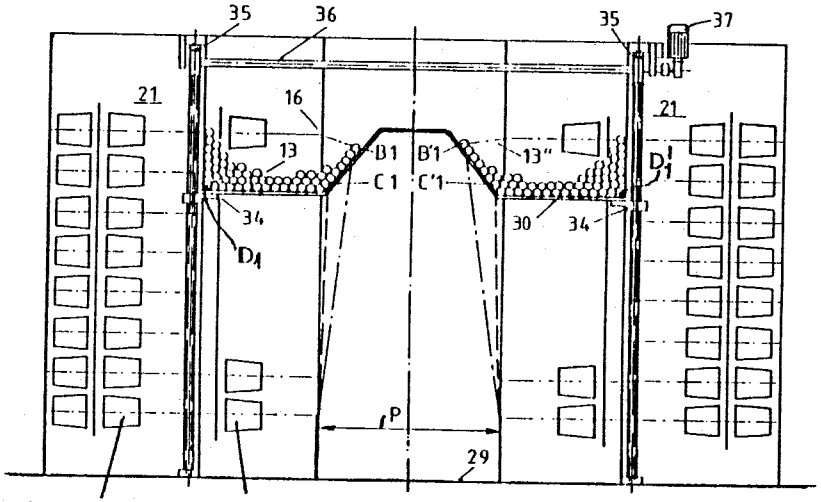
FIG. 8 is a vertical section taken along line VIII—VIII of FIG. 6.
Figure 7:
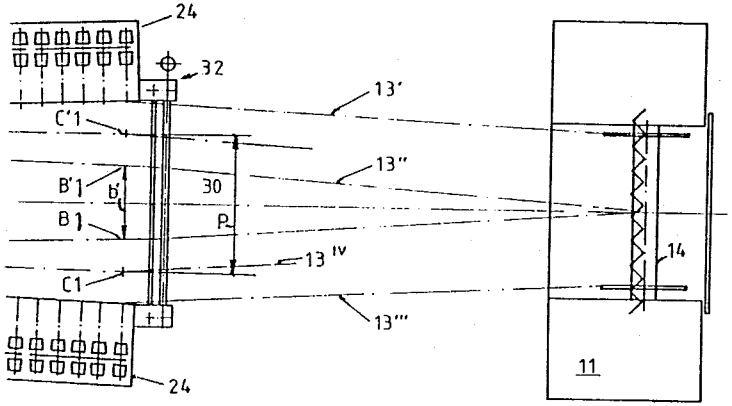
FIG. 7 is a smaller-scale top view taken in the direction of arrow VII of FIG. 6.

The gap b is sufficiently wide for an agile operator to enter the creel to service it at its downstream end but the lowermost filaments are too close to the floor indicated at 29 to allow such access. Accordingly the creel 10 of this invention is provided with a yarn lifter 30 formed as a nonstraight bar having as shown in FIG. 5 a pair of coaxial outer sections 31 extending horizontally and perpendicular to the direction L, a pair of upwardly and inwardly angled sections 31′ rising from the inner ends of the outer sections 31, and a horizontal central section 31″ of a length h slightly smaller then the width b joining the upper ends of the sections 31′. The outer ends of the sections 31 are carried in supports 34 fixed to the lower ends of racks 33 rising vertically to mesh with gears 35 carried on a shaft 36 driven by a motor 37. Thus rotation of the shaft 36 by the motor 37 can raise the yarn lifter 30 from the down position illustrated in FIG. 5 out of contact with all of the filaments 13 through a distance equal to about two-thirds of the height of the creel 10 to the raised position of FIG. 8. This raises the corners B,C,D, and B′,C′,D′ of the two warps of filaments 13 to the upper positions B1,C1,D1 and B′1,C′1,D′1, so that most of the filaments 13 extend at a substantial angle to the horizontal as well as to the direction L. Thus the operator can easily duck under the raised filaments 13 and enter the creel 10 from its downstream end, that is from the right as seen in FIG. 6.

In addition, according to this invention, the winder 11 maintains the filaments 13 taut as the bar 30 is lowered. This is achieved by a slow creep control 11*a* operatively connected to the winder 11 to rotate the warp beam 14 at a very slow creep as the bar 30 is being lowered to prevent the slack thus created from causing adjacent filiments 13 to touch and become tangled.

the racks 33 could be replaced by other geared members such as by threaded spindles that are rotatable but not vertically movable and that are threaded at their lower ends in the respective lifter supports 34 and provided at their upper ends with pinions rotated by worms driven by the motor 37. Such an arrangement would take up substantially less headroom than the illustrated system.

I claim:

1. In combination with a winder having a predetermined width and operable to draw in across this width in a longitudinal transport direction a warp of filaments from respective bobbins, a creel comprising:

a support frame having respective supports for the bobbins and having a pair of generally like sides each provided with about a respective half of the supports, the sides being elongated in the transport direction and having downstream ends spaced by at least the winder width, upstream ends more closely spaced, and inner faces turned transversely inward toward each other;

means including respective deflectors on the inner faces of the support sides for guiding the filaments inward and transversely of the transport direction from the respective supports and then longitudinally in the transport direction to the winder, the filaments normally running from the deflectors to the winder without touching any substantial guide structure; and means at the downstream ends for raising and splitting the warp of filaments for operator access through the split warp to between the sides of the support frame.

2. The creel defined in claim 1 wherein the upstream ends are spaced apart by a gap sufficiently wide for a machine operator to pass through.

3. The creel defined in claim 1 wherein the deflectors are spaced such that the filaments from one of the sides are laterally spaced at the downstream ends from the filaments of the other side by a gap sufficiently wide for a machine operator to pass through.

4. The creel defined in claim 1 wherein the sides form a V open in the transport direction toward the winder.

5. The creel defined in claim 4 wherein the sides form an angle of less than 20°.

6. The creel defined in claim 1 wherein the raising and splitting means includes an at least partially horizontal bar vertically displaceable on the frame.

7. The creel defined in claim 1 wherein the bar has a pair of transversely spaced horizontal portions having inner ends and a pair of upwardly inclined portions extending inward from the inner ends.

8. The creel defined in claim 7 wherein the upwardly inclined portions symmetrically flank a centerline of the creel extending in the transport direction.

9. The creel defined in claim 7 wherein the horizontal portions have outer ends vertically displaceable supported on the respective support sides.

10. The creel defined in claim 9 wherein the raising and splitting means includes a drive motor mounted on the support, and a mechanical linkage connecting the motor to the outer ends.

11. The creel defined in claim 7 wherein the winder is provided with means for maintaining the filaments taut as the bar is lowered.

12. In combination with a winder having a predetermined width and operable to draw in across this width in a longitudinal transport direction a warp of filaments from respective bobbins, a creel comprising:

a V-shaped support frame open at an angle of less than 20°, having respective supports for the bobbins, and having a pair of generally like sides each provided with about a respective half of the supports, the sides being elongated in the transport direction and having inner faces turned transversely inward toward each other, downstream ends spaced by at least the winder width plus a width sufficiently wide for a machine operator to pass through, and upstream ends spaced apart by a gap sufficiently wide for a machine operator to pass through;

means including respective deflectors on the inner faces of the support sides for guiding the filaments inward and transversely of the transport direction from the respective supports and then longitudinally in the transport direction to the winder, the filaments normally running from the deflectors to the winder without touching any substantial guide structure; and means at the downstream ends for raising and splitting the warp of filaments for operator access through the split warp to between the sides of the support frame at the downstream ends.

* * * * *